United States Patent [19]

Harding

[11] 3,998,367

[45] Dec. 21, 1976

[54] SHOULDER HARNESS FOR CARRYING AN ARCHERY BOW

[76] Inventors: Jack F. Harding, 672 S. Burmont Ave., Lafayaette, Colo. 80026

[22] Filed: Feb. 4, 1974

[21] Appl. No.: 439,109

[52] U.S. Cl. ..... 224/1 A; 224/5 R; 224/58

[51] Int. Cl.[2] ..... F41B 5/00

[58] Field of Search ..... 224/1 A, 1 R, 3, 2 A, 224/2 D, 5 M, 5 Z, 5 R, 5 A, 5 B, 26 R, 26 B, 49, 58

[56] References Cited

UNITED STATES PATENTS

| | | | |
|---|---|---|---|
| 1,292,875 | 1/1919 | Randall | 224/1 A |
| 2,915,233 | 12/1959 | Moomaw | 224/3 |
| 3,168,971 | 2/1965 | Goertzen | 224/1 R |

FOREIGN PATENTS OR APPLICATIONS

| | | | |
|---|---|---|---|
| 498,433 | 10/1910 | France | 224/1 A |
| 208,445 | 10/1907 | Germany | 224/3 |
| 73,084 | 2/1948 | Norway | 224/1 A |
| 327,158 | 8/1970 | Sweden | 224/1 A |
| 64,171 | 11/1927 | Sweden | 224/1 A |

*Primary Examiner*—Robert J. Spar
*Assistant Examiner*—Jerold M. Forsberg
*Attorney, Agent, or Firm*—Thomas W. O'Rourke

[57] ABSTRACT

The primary object of this invention is the provision of an adjustable strap harness for carrying an archery bow on the back of a person.

4 Claims, 2 Drawing Figures

12
11
10
26
13
25
14
15
16
24
21
17
19
18
20
23
22

SHOULDER HARNESS FOR CARRYING AN ARCHERY BOW

An additional object of the invention is to provide the user freedom of movement for both hands and both arms.

A further object of the invention is to allow the user to easily and quickly bring the bow into proper shooting position.

A still further object of the invention is to provide adequate adjustment to adapt the invention to varying clothing weights, person sizes, back packs, and right or left handed users.

Other objects of the invention are characterized by its simplicity and reliability as a finished article of high quality suitable for the purposes described.

In the drawings.

Having reference now to the drawings, wherein similar reference characters refer to similar parts throughout the two views.

Figure 1:
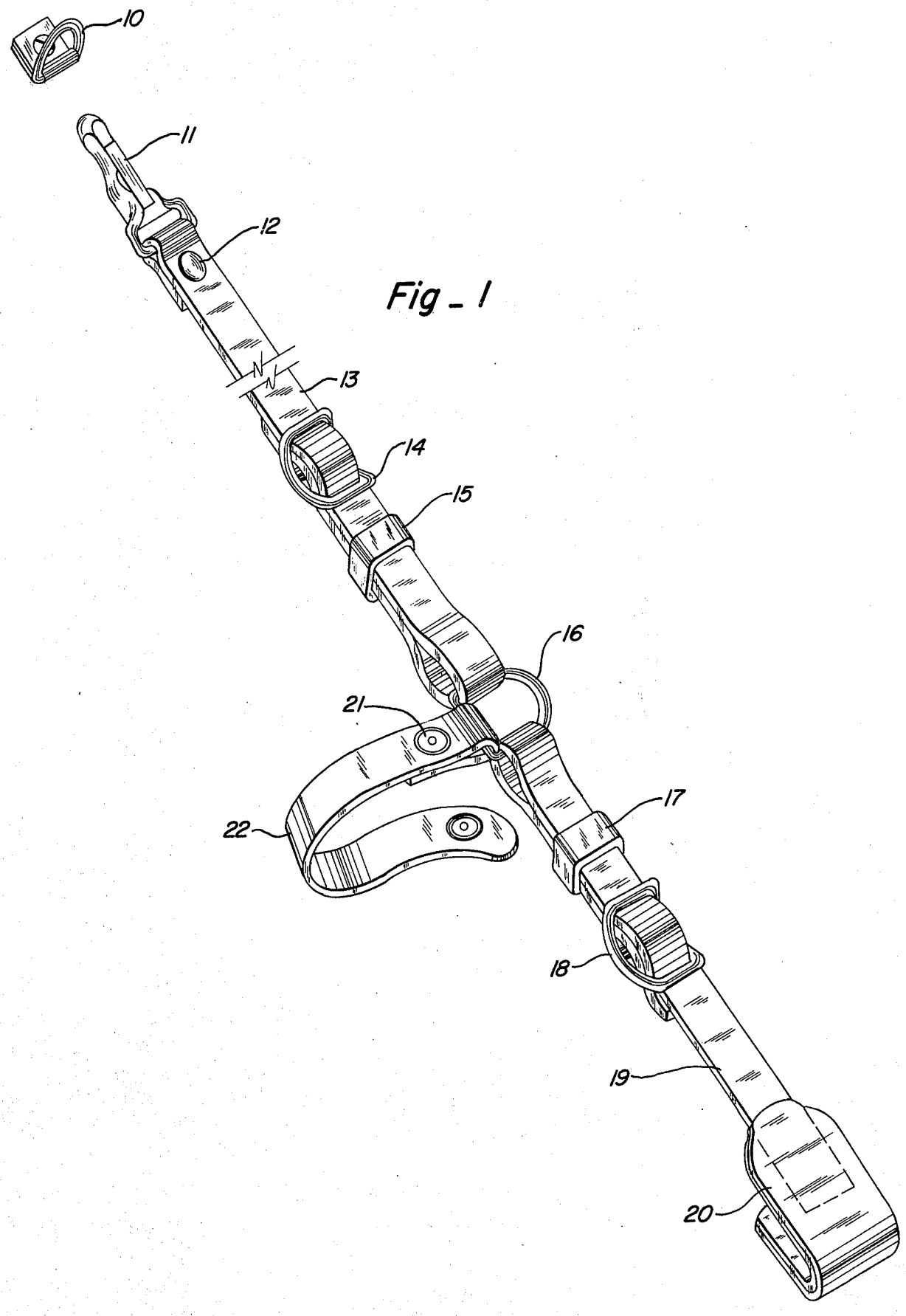
FIG. 1 is a perspective view of the present invention illustrating elements and steps in the fabrication thereof.

In FIG. 1 there is a D ring and D ring clip 10 that is screwed to the bow at the bottom part of the handle riser and on the same side as the arrow shelf of the bow.

There is a length adjustable strap 13 of leather or other suitable strap material attached at one end to a utility snap 11 by rivet 12 or by adhesive. The other end of the strap 13 goes through a D ring 16 and doubles back through an adjustable buckle 14. There is a keeper 15 around the doubled portion of strap 13.

One end of a length adjustable strap 19, of leather or other suitable strap material, goes through D ring 16 and doubles back through an adjustable buckle 18. There is a keeper 17 around the doubled portion of strap 19. The other end of strap 19 is attached by rivet or adhesive to retainer hook 20. The retainer hook 20 is formed from metal or other suitable material which is capable of holding a rigid hook shape. The inside of retainer hook 20 is covered or coated with any suitable material which is capable of preventing abrasion and noise when hooked over the bow limb.

One end of another strap 22, of leather or other suitable strap material, is attached to the flat side of D ring 16 by the stud and eyelet portion of a snap fastener 21. The other end of strap 22 is fitted with the button and socket portion of snap fastener 21 so strap 22 can be snapped shut to form a loop.

Figure 2:
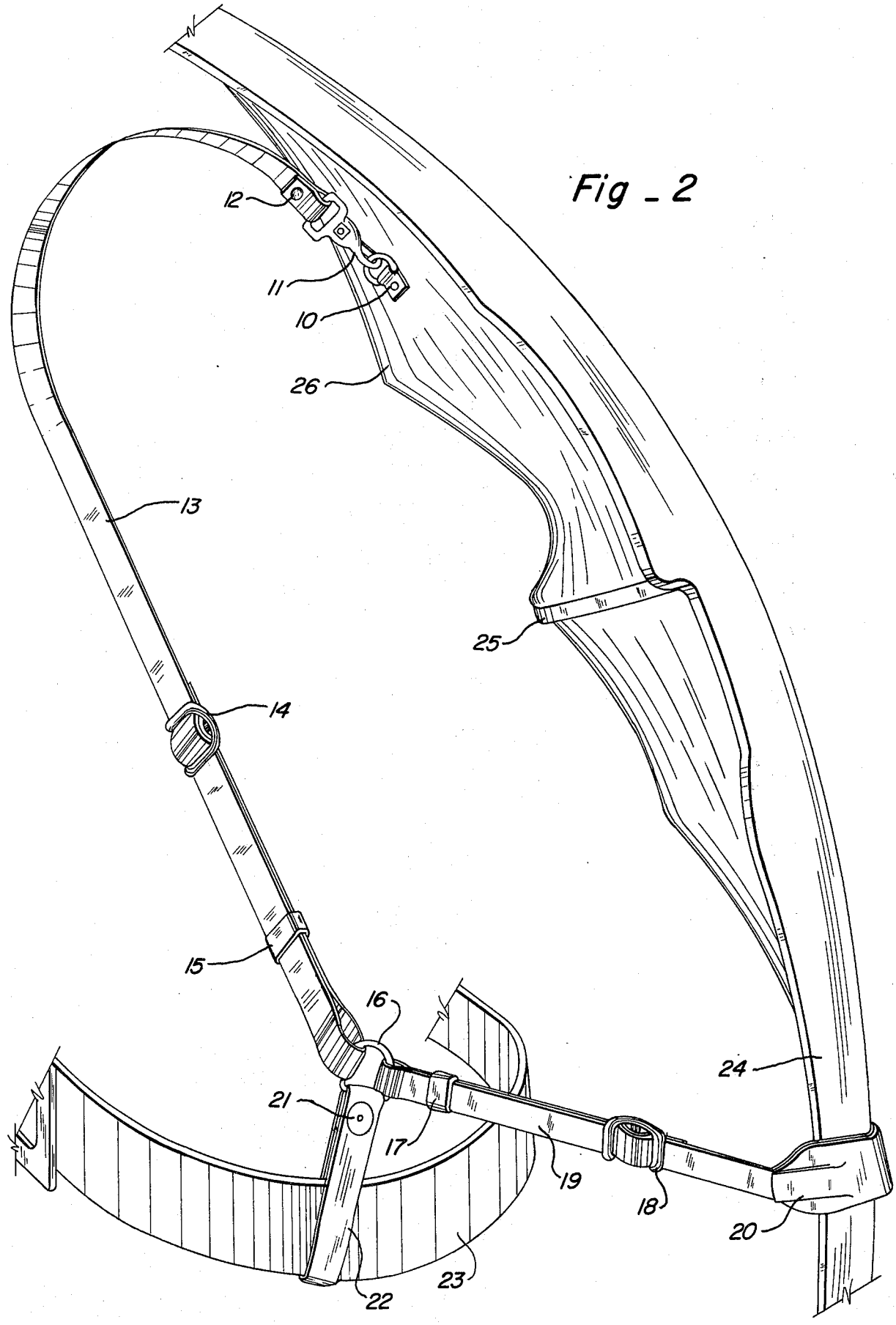
FIG. 2 is a perspective view of the invention in proper wearing position for a right handed user illustrating the method of use and the relation of the various elements to the wearer's body and the bow.

In FIG. 2 strap 22 is snapped shut around the user's belt 23 or belt loop, on the left side of the body waist high.

Strap 13 extends from D ring 16 up across the user's chest, passes over the user's right shoulder, and the utility snap 11 is snapped to the D ring and clip 10.

D ring and clip 10 is screwed to the bow at the bottom part of the handle riser 26 on the same side as the arrow shelf 25. The length of strap 13 can be adjusted by the buckle 14.

Strap 19 extends from D ring 16 toward the back of the left side of the user's body where retainer hook 20 hooks over the limb 24 of the bow, holding the bow against the user's back. The length of strap 19 can be adjusted by the buckle 18.

For a left handed user the wearing of the invention is just opposite from the above, starting by snapping strap 22 on the right side of the body instead of the left side.

To bring the bow into shooting position the user releases retaining hook 20 from the bow limb 24. The user then pulls the bow over the shoulder to the front of the body into shooting position. As the bow is on the back of the user in an upside down position, it comes into shooting position correct side up.

What is claimed is:

1. A bow and harness structure adapted to be carried in transit on the back of a user and, alternatively, being quickly repositionable for casting an arrow, the structure comprising an archery bow, a harness attached to the bow adjacent the center portion of the bow by attachment means, the harness being in the form of a first strap connected at one end to the attachment means and connected at the other end to a closed loop belt member by a ring member, the harness further including a second strap member connected to the belt loop and first strap member at the ring member and carrying a U-shaped hook retainer adapted to releasably engage and secure the bow during transit at a position on the opposite side of the bow center portion as that to which the attachment means is secured, whereby the bow may be carried in a vertical position on the users back with the U-shaped retainer attached to the bow at one end of the harness and the attachment means attached to the bow at the other end of the harness but be quickly repositioned by releasing the U-shaped member and moving the bow to the front of the user in a vertical position to cast an arrow.

2. A bow and harness structure as set forth in claim 1 in which the attachment means includes a ring member secured to the bow in which the attachment means includes a utility snap.

3. A bow and harness structure as set forth in claim 1.

4. A bow and harness structure as set forth in claim 1, in which the belt loop member is an enlongated strap having complementary portions of a snap fastener means secured to each end portion thereof, whereby the loop may be opened to facilitate attachment to a belt.

* * * * *

UNITED STATES PATENT OFFICE

CERTIFICATE OF CORRECTION

PATENT NO. : 3,998,367

DATED : December 21, 1976

INVENTOR(S) : Jack F. Harding

It is certified that error appears in the above-identified patent and that said Letters Patent are hereby corrected as shown below:

Column 2, Claim 3, line 1 after "Claim 1" insert --in which the attachment means includes a ring member secured to the bow.--

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*